United States Patent [19]

Fogarassy

[11] Patent Number: 4,938,531

[45] Date of Patent: Jul. 3, 1990

[54] ADJUSTMENT MECHANISM FOR CHAIRS

[75] Inventor: Steven Fogarassy, Yeronga, Australia

[73] Assignee: Email Limited, New South Wales, Australia

[21] Appl. No.: 281,469

[22] Filed: Dec. 8, 1988

[30] Foreign Application Priority Data

Mar. 23, 1988 [AU] Australia ..... P17389

[51] Int. Cl.[5] ..... A47C 1/032

[52] U.S. Cl. ..... 297/300; 297/306

[58] Field of Search ..... 297/300, 306, 301, 316, 297/319, 313

[56] References Cited

U.S. PATENT DOCUMENTS

| | | | |
|---|---|---|---|
| 3,034,828 | 5/1962 | Kurihara | 297/306 |
| 3,672,721 | 6/1972 | Williams | 297/306 |
| 3,945,651 | 3/1976 | Boswinkle . | |
| 3,989,297 | 11/1976 | Kerstholt | 297/306 |
| 4,062,587 | 12/1977 | Wolters . | |
| 4,198,094 | 4/1980 | Bierkues et al. | 297/306 |
| 4,438,978 | 3/1984 | Arild . | |
| 4,627,662 | 12/1986 | Carter et al. . | |
| 4,629,249 | 12/1986 | Yamaguchi | 297/300 |
| 4,636,004 | 1/1987 | Neumuller | 297/306 |
| 4,682,815 | 7/1987 | Steifensand | 297/300 |

FOREIGN PATENT DOCUMENTS

81/0004 1/1981 PCT Int'l Appl. .

*Primary Examiner*—Laurie K. Cranmer

*Attorney, Agent, or Firm*—DeLio & Associates

[57] ABSTRACT

This device relates to an adjustment mechanism for adjusting the angular positions of a seat and a back rest of a chair. The mechanism comprises a fixed horizontal beam having a seat support member pivotally connected thereto by a transverse pivot adjacent one end of the beam and a back support member pivotally connected to the seat support member by a second transverse pivot. Opposed adjacent ends of the fixed beam and the back support member have spaced plates fixed at their adjacent ends with elongate aligned apertures. Locking means are mounted on the seat support member extending through the aligned apertures for locking the plates on the seat support member and the back support member into selected angular positions with respect to the horizontal beam.

6 Claims, 2 Drawing Sheets

ADJUSTMENT MECHANISM FOR CHAIRS

BACKGROUND OF THE INVENTION

This invention relates to an improved chair construction wherein the seat support and back support are independently adjustable within a range of angular positions and wherein selected positions of the supports may be releasably and effectively locked by an occupant of the chair by the operation of simple control means.

In the field of office and other working chairs it is well known that optimum ergonomic positioning of an occupant is determined by physical characteristics of the individual concerned as well as the type of operation intended to be undertaken by the occupant. Factors which have been recognized as being the major requirements for ergonomic positioning are height of the seat support, height of back support and the angular inclinations of the seat support and back support. In order to provide for different occupants and different activities it is well-known to make the above parameters adjustable.

In order to provide adjustment of the angular inclination of the seat support or back support for a working chair, various clutch operated mechanisms have been developed for locking the seat support or back support into a selected angular position. Examples of such constructions are disclosed in U.S. Pat. Nos. 4,062,587, 4,198,094 and International Patent Application W081/00044. Such clutch operated mechanisms have been further developed to provide simultaneous adjustment of the seat support and back support of a chair and which lock those supports into selected angular positions. An example of such mechanism is disclosed in U S. Pat. No. 4,636,004.

However known mechanisms for providing angular adjustment of both the seat support and back support of a chair are complex in construction and assembly as well as providing limited angular movement of the seat support in particular. Moreover the known clutch constructions are bulky and not always effective in maintaining a seat support and a back support in a selected position.

The present invention provides an improved apparatus for supporting a seat of a working chair which provides independent angular adjustment of a seat support and back support and which is simpler than prior constructions while providing a broad range of angular positions of the seat member and back member and effective locking of those members in a selected angular position.

SUMMARY OF THE INVENTION

An adjustable seat and back support apparatus for a chair according to the invention comprises (a) an elongate longitudinally extending base member adapted for attachment to the upper end of a vertical support member of a chair;

(b) an elongate longitudinally extending seat support member pivotally connected to said base member intermediate its ends for pivotal movement about a first transverse axis and extending from one end thereof;

(c) a further elongate, longitudinally extending support member adapted to support a back support for a chair said further support member being pivotally connected to said seat support member for pivotal movement about a second transverse axis; said adjustable seat and back support apparatus further including locking means for locking said seat support member and said further support member into selected angular positions of said seat support member and said further support member relative to said base member resulting from pivotal movement of said seat support member and said further support member about said first and second transverse axes respectively, said locking means comprising (d) a first plurality of flat longitudinally extending transversely spaced plate members projecting from said one end of said base member and rigidly connected thereto;

(e) a second plurality of flat, longitudinally extending transversely spaced plate members projecting from an adjacent end of said further support member and rigidly connected thereto;

(f) transverse shaft means slidably mounted on said seat support member for longitudinal movement and extending through aligned apertures in said first and second plurality of plate members for urging said first and second plurality of plate members into fixed relation with said shaft means on longitudinal movement of said shaft means in one direction whereby said seat support member and said further support member are releasably locked into a fixed angular relation with said base member.

The first and second plurality of plate members may be interleaved in which case the transverse shaft means comprises a single shaft extending through aligned arcuate apertures in said first and second plurality of interleaved plate members. The transverse shaft may include fixed and slidably movable abutments mounted on the shaft adjacent outer ones of the first and second plurality of plate members whereby longitudinal movement of the shaft causes the movable abutments to move towards a fixed abutment thereby urging the plate members of the first plurality of plate members into frictional contact with the plate members of the second plurality of plate members. If desired adjacent members may be separated by spacer members disposed between adjacent plate members.

Alternatively, the transverse shaft means may comprise two shafts each mounted for longitudinal movement on the seat support member with one shaft extending through aligned apertures in the first plurality of plate members and the other extending through aligned apertures in the second plurality of plate members. The plate members in each plurality may be spaced by washers slidably mounted on each shaft and interleaved between adjacent plate members in each plurality. Each shaft suitably includes a fixed and a slidable abutment member located on the outer ones of the first plurality and second plurality of plate members respectively. With this arrangement the seat support member and the further support member may be independently and releasably looked into fixed angular relation with the base member.

DETAILED DESCRIPTION OF THE PREFERRED EMBODIMENT

Figure 1:
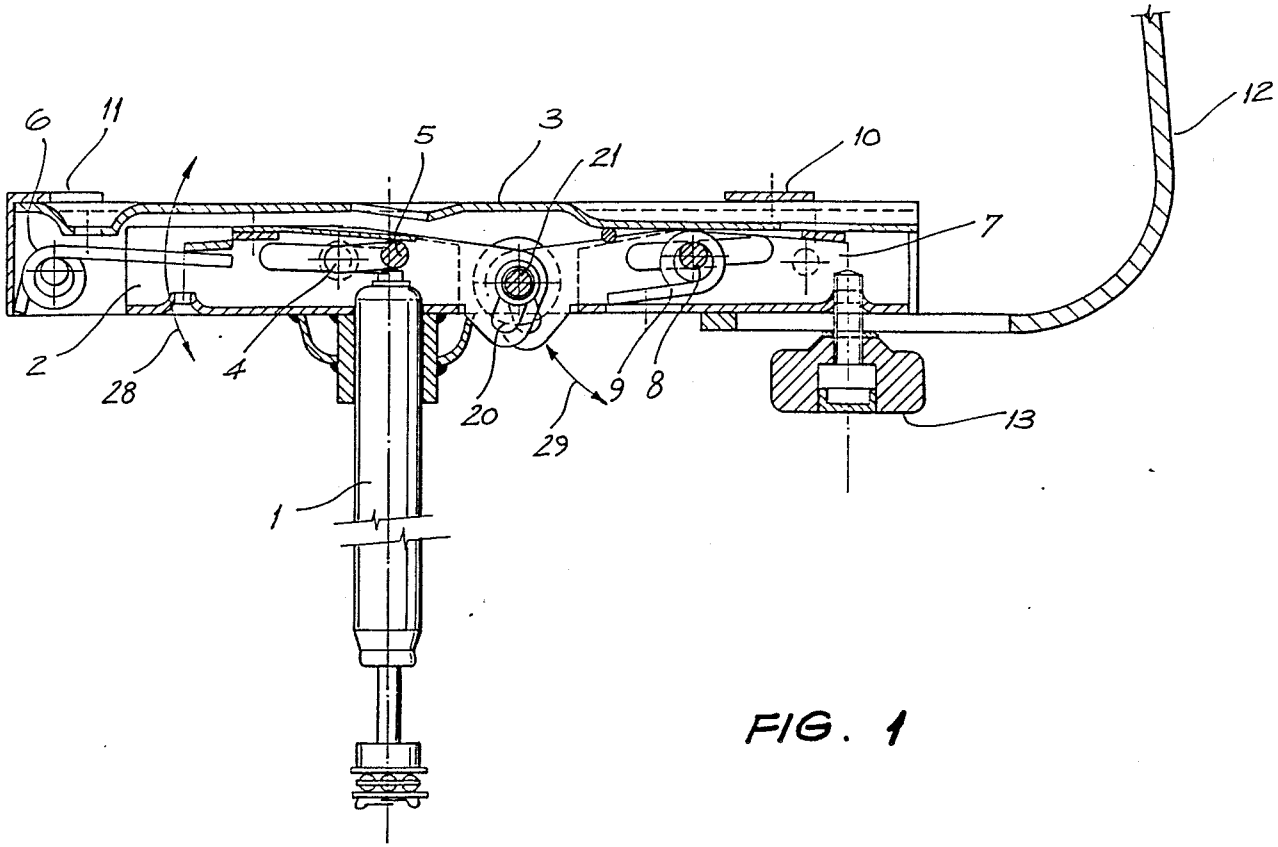
FIG. 1 represents a cross-sectional side elevation of an adjustable seat support and back support for a chair according to the invention along the line A-A of FIG. 2.
Figure 2:
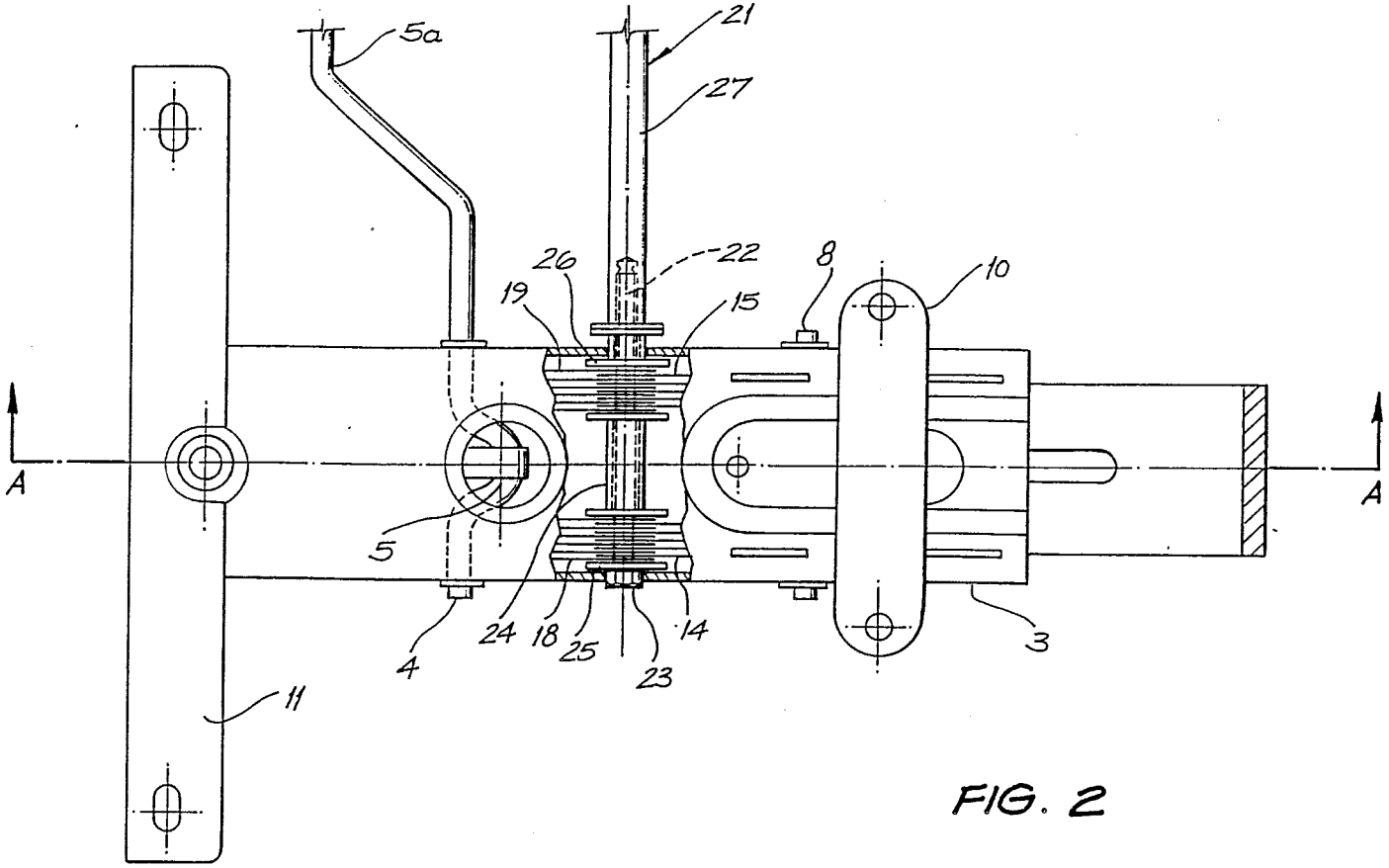
FIG. 2 represents a plan view of the apparatus illustrated in FIG. 1 with part of the seat support member removed to show the looking means.

In FIG. 1, 1 is a gas cylinder height adjustment means providing columnar support for a chair. Height adjustment means 1 is connected to elongate longitudinally extending base member 2 by socket means adjacent one end thereof. Base member 2 is a longitudinally extending channel shaped member having upwardly extending side walls. Seat support member 3 is a longitudinally extending channel member having downwardly extending sidewalls and is disposed over base member 2 and pivotally connected thereto by shaft 4 to pivot about a transverse axis. Shaft 4 may be provided with a cranked portion 5 intermediate the side walls of base member 2 for engaging an actuating valve of the gas cylinder height adjustment means 1 and includes a further cranked portion 5*a* adjacent an end thereof which acts as a handle. Shaft 4 thereby also may operate to actuate the chair height adjustment means as well as provide the means for pivoting seat support member 3 about base member 2. With this configuration of shaft 4, bushes are provided on the shaft to provide the pivotal connection between base member 2 and seat support member 3. This construction enables the cranked portion 5 of shaft 4 to pass through enlarged apertures in the side walls of base member 2 and seat support member on assembly of the apparatus. Spring means 6 urge base member 2 and seat support member 3 into substantially aligned relation.

Seat support member 3 extends rearwardly of base member 2. On the rearwardly extending portion, longitudinally extending support member 7 is pivotally mounted by transverse shaft 8. Support member 7 is also a channel member with upwardly extending side walls and is in seat support member 3. Spring means 9 urges support member 7 into alignment with seat support member 3.

Seat support member 3 is provided with cross members 10 and 11 rigidly affixed thereto which are intended for attachment of a chair seat (not shown). Support member 7 supports back support member 12 to which a back support of a chair is intended to be attached. Back support member 12 is slidably connected to support member 7 by threaded means operated by hand wheel 13. The position of back support member 12 can thus be adjusted rearwardly by means of the hand wheel.

One end of support member 7 terminates opposite to but spaced from the rear end of base member 2. At the opposed adjacent ends of base member 2 and support member 7 are a plurality of longitudinally extending friction plates spaced transversely of said members. Friction plates 14, 15 are rigidly affixed to support member 7 and extend from an inner end thereof while friction plates 18, 19 are rigidly affixed to and extend from an opposed end of base member 2 and are interleaved with friction plates 14, 15. With this arrangement friction plates 18, 19 are located on opposite sides of height adjustment means 1 providing a particularly compact construction whle also providing efficient looking of the base member 2, seat support member 3 and back support member 7. Friction plates 14, 15 and 18, 19 are provided with aligned arcuate apertures 20. As will be seen from FIG. 1 elongate slots are provided in plates 18, 19 to accommodate shaft 4 for assembly of the apparatus.

Extending through apertures 20 is transverse shaft 21 which is mounted on the side walls of seat support member 3 for longitudinal movement. Shaft 21 comprises threaded portion 22 extending across seat support member 3. The free end of threaded portion 22 terminates in a hexagonal head 23 which is non-rotatably located in a correspondingly shaped aperture in a side wall of seat support member 3 but is free to move longitudinally.

Mounted on threaded portion 22 is sleeve 24 having at each end a radially extending abutment adapted to bear on the inner clutch plates of the groups 14, 18 and 15, 19. Abutment 25 is located adjacent the outer clutch plate of group 14, 18 and retained by hexagonal head 23 while abutment 26 is located adjacent the outer clutch plate of group 15, 19 and is slidable on shaft portion 22.

Shaft portion 27 is threadedly connected to shaft portion 22 and bears against abutment 26. This shaft portion is arranged so that rotation in one direction causes portions 22 and 27 to be drawn together longitudinally whereby abutment 25 is forced towards the opposed abutment on sleeve 24 and abutment 26 is forced towards the other abutment on sleeve 24 thereby forcing friction plates 14 and 18 and 15 and 19 into frictional engagement. Rotation of shaft portion 27 in the other direction permits outward longitudinal movement of shaft portions 22 and 27 and thereby releases the clutch plates from frictional engagement due to the elasticity of the plates.

Accordingly, when incorporated in a chair, the invention enables the seat and back rest of the chair to be angularly adjusted by an occupant by rotating shaft portion 27 to free clutch plates 14, 18 and 15, 19 from frictional engagement and urging the seat and back rest into the desired angular positions against the force of springs 6. When the plates 14, 18 and 15, 19 are freed, seat support member 3 may rotate as shown by arrow 28 about shaft 4 and support member 7 may rotate as shown by arrow 29 about shaft 8. The occupant may then lock the seat and back rests in the desired positions by rotating shaft portion 27 to re-engage the plates 14, 18 and 15, 19.

It will be appreciated that the invention permits substantial angular movement of seat support member 3 relative to base member 2 since the pivot axis of support member 3 can be located adjacent the rearward end of the base member 1. Moreover, the invention provides effective locking of the seat member and back support member since the turning moment of these members is small due to the proximity of shafts 4, 7 and 16. In the result the invention provides a compact and unobtrusive mechanism for providing angular adjustment of a seat and back support members.

In certain circumstances it may be desired to permit the seat support member 3 and/or the support member 7 to support an occupant against the resilient force of springs 6 and/or 9 respectively i.e. with plates 14, 18 and 15, 19 being disengaged from frictional engagement. For this purpose springs 6 and/or 9 may be constituted by coil springs with means for adjusting the spring tension.

I claim

1. Adjustable seat and back support apparatus for a chair comprising (a) an elongate longitudinally extending base member adapted for attachment to the upper end of a vertical support member for a chair;

(b) an elongate longitudinally extending seat support member pivotally connected to said base member intermediate its ends for pivotal movement about a first transverse axis and extending from one end thereof;

(c) a further elongate, longitudinally extending support member adapted to support a back support for a chair said further support member being pivotally connected to said seat support member for pivotal movement about a second transverse axis; said adjustable seat and back support apparatus further including locking means for locking said seat support member and said further support member into selected angular positions of said seat support member and said further support member relative to said base member resulting from pivotal movement of said seat support member and said further support member about said first and second transverse axes respectively said locking means comprising (d) a first plurality of flat longitudinally extending transversely spaced plate members projecting from said one end of said base member and rigidly connected thereto;

(e) a second plurality of flat, longitudinally extending transversely spaced plate members projecting from an adjacent end of said further support member and rigidly connected thereto and interleaved with said first plurality of plate members; and (f) transverse shaft means slidably mounted on said seat support member for movement along the longitudinal axis of said shaft means and extending through aligned apertures in said first and second plurality of plate members for urging said first and second plurality of plate members into fixed relation with said shaft means on movement of said shaft means along its longitudinal axis in one direction whereby said seat support member and said further support member are releasably locked into a fixed angular relation with said base member.

2. Adjustable seat and back support apparatus for a chair as claimed in claim 1 wherein said support means includes gas actuated height adjustment means and the pivotal connection between the base member and seat support member comprises a shaft including a cranked portion said cranked portion being adapted to actuate said gas actuated height adjustment means to vary the height of the chair.

3. Adjustable seat and back support apparatus for a chair as claimed in claim 1 wherein said first and second plurality of plate members are interleaved and said transverse shaft means comprises a shaft slidably mounted on said seat support member extending through aligned apertures in said first and second plurality of plate members, said shaft having fixed and slidable abutments disposed on an outer one of said first and second plurality of plate members whereby movement of said shaft along its longitudinal axis in one direction causes said slidable abutment or abutments to move along said shaft towards a respective fixed abutment forcing said first and second plurality of plate members into frictional engagement.

4. Adjustable seat and back support apparatus as claimed in claim 3 wherein said seat member is channel shaped in cross-section with downwardly extending side walls, said transverse shaft comprises a threaded portion with said fixed and movable abutments mounted thereon non-rotatably mounted on said side walls and a rotatable portion threadedly engaging said threaded portion and abutting an outer one of said movable abutments whereby rotation of said rotatable portion in one direction moves said movable abutments along said threaded portion towards said fixed abutment.

5. Adjustable seat and back support apparatus as claimed in claim 1 wherein said transverse shaft means comprises a first transverse shaft slidably mounted on said seat support member for movement along the longitudinal axis of said second shaft and extending through aligned apertures in said first plurality of plate members and a second transverse shaft slidably mounted on said seat support member for movement along the longitudinal axis of said second shaft and extending through aligned apertures in said second plurality of plate members, each said shaft including a fixed abutment adjacent an outer one of the first and second plurality of plate members respectively and a slidable abutment adjacent the other outer one of said first abutment adjacent the other outer one of said first and second plurality of plate members respectively, a spacer member slidably mounted on each shaft between adjacent plate members wherein movement of said first shaft along its longitudinal axis in one direction causes the slidable abutment on said shaft to move towards the fixed abutment on said shaft thereby causing said first plurality of plate members to move into frictional engagement with the inter leaved spacer members whereby said seat support member is releasably retained in a selected angular position with respect to said base member while rotation of said second shaft in one direction causes said slidable abutment mounted on said shaft to move towards the fixed abutment on said shaft thereby causing said second plurality of plate members to move into frictional contact with the interleaved spacer members whereby said further support member is releasably retained in a selected angular position with respect to said base member.

6. Adjustable seat and back support apparatus as claimed in claim 4 wherein said seat support member is channel shaped in cross-section with downwardly extending side walls, said first and second shaft being slidably mounted on opposite side walls, each said shaft including a threaded position non-rotatably mounted on a respective side wall and including said fixed and movable abutments mounted on said shaft and a rotatable portion threadedly engaging said threaded portion and adapted to engage said movable abutment whereby rotation of said rotatable portion in one direction moves said slidable abutment towards said fixed abutment.

* * * * *